US006615742B1

(12) United States Patent
Swanson

(10) Patent No.: US 6,615,742 B1
(45) **Date of Patent: *Sep. 9, 2003**

(54) PORTABLE RACK FOR BUILDING MATERIALS AND METHOD OF USING SAME

(76) Inventor: Donald F. Swanson, 2483 Elm Dr., Brier, WA (US) 98036

( * ) Notice: Subject to any disclaimer, the term of this patent is extended or adjusted under 35 U.S.C. 154(b) by 0 days.

This patent is subject to a terminal disclaimer.

(21) Appl. No.: 10/140,970

(22) Filed: May 7, 2002

Related U.S. Application Data

(63) Continuation of application No. 09/929,857, filed on Aug. 13, 2001, now abandoned, which is a continuation of application No. 09/399,628, filed on Sep. 20, 1999, now Pat. No. 6,302,034.

(51) Int. Cl.[7] ..... B65D 19/44
(52) U.S. Cl. ..... 108/55.5; 108/55.1
(58) Field of Search ..... 108/52.1, 55.1, 108/55.5, 57.17, 57.31, 57.32, 51.11, 56.1, 53.5

(56) References Cited

U.S. PATENT DOCUMENTS

| | | | | | |
|---|---|---|---|---|---|
| 3,123,021 | A | * | 3/1964 | Evans | 108/53.5 |
| 3,147,860 | A | * | 9/1964 | Kean, Sr. et al. | 108/53.5 X |
| 3,506,138 | A | * | 4/1970 | Travis | 108/53.5 X |
| 3,848,747 | A | * | 11/1974 | Thompson | 108/53.5 X |
| 4,976,092 | A | * | 12/1990 | Shuert | 108/55.1 X |
| 5,456,189 | A | * | 10/1995 | Belle Isle | 108/57.17 |
| 5,676,066 | A | * | 10/1997 | Cavalier et al. | 108/55.1 |
| 6,119,604 | A | * | 9/2000 | Thomsen | 108/55.1 |

FOREIGN PATENT DOCUMENTS

| | | | | |
|---|---|---|---|---|
| FR | 1357083 | * | 2/1964 | 108/53.5 |
| FR | 2692229 | * | 12/1993 | 108/52.1 |
| JP | 5147653 | * | 6/1993 | 108/52.1 |

* cited by examiner

*Primary Examiner*—Janet M. Wilkens
(74) *Attorney, Agent, or Firm*—Davis Wright Tremaine

(57) ABSTRACT

A portable rack for assembling packages of building materials. The rack comprises a base having a proximal side, a distal side, a top, a bottom, and a pair of channels extending between the proximal side and the distal side, the channels being designed to receive the forks of a forklift, and a plurality of elongated members attached to the proximal side and projecting upwardly from the base. The process for using the rack comprises placing the building materials onto the base of the rack using the forklift, moving the building materials toward the elongated members until the building materials abut at least one of the elongated members, and pulling the forks out from under the building materials.

30 Claims, 10 Drawing Sheets

PORTABLE RACK FOR BUILDING MATERIALS AND METHOD OF USING SAME

This application is a continuation under 1.53(b) of application Ser. No. 09/929,857 filed Aug. 13, 2001, now abandoned which is a continuation under 1.53(b) of application Ser. No. 09/399,628 filed Sep. 20, 1999 which issued as U.S. Pat. No. 6,302,034 on Oct. 16, 2001, both hereby incorporated by reference.

FIELD OF THE INVENTION

The present invention provides a portable rack and a method of using the rack to put together packages of products, and in particular to a portable lumber rack useful for assembling packages of building materials.

BACKGROUND

Building contractors usually purchase their materials for a particular job from lumber yards or other suppliers of building materials. Typically, the contractor furnishes the supplier with a list of the materials they need, and the supplier assembles the order from the inventory in their yard. Contractor orders are customarily assembled into packages specific to the type of work a contractor does. For example, a siding contractor would require a package of siding materials, while a framing contractor would require a package of framing materials. These packages must be regularly shaped so that all the materials in the package can be securely strapped together for transportation to the contractor's job site.

Every contractor order can include a wide variety of building materials, such as plywood, lumber, siding, drywall, etc., so suppliers must keep a large variety of inventory on hand. This inventory is often stored in different areas of a large yard, with similar products grouped together. In most lumber yards, there is a central area where contractor packages are put together. Once put together, the packages are either carried to a pick-up area to be loaded onto a truck, or the truck is brought to the central area so that the package can be loaded on the truck for delivery.

Assembling a contractor package can require a substantial amount of time and labor, because the person assembling the package must go to different parts of the lumber yard, pick up the item needed (usually with a forklift) and bring it back to the central package assembly area. Because some of the items are unwieldy, the assembler cannot usually load multiple items in the forks of a forklift; the items could be damaged or fall off the forklift. Moreover, the presence of one article already on the forks makes it difficult or impossible to load another item onto the forks unless done by hand. For a standard contractor order, which may involve items scattered throughout the full extent of the lumber yard, assembling the package requires many trips to and from the central assembly area. This is analogous to a person grocery shopping without a shopping cart; such a person would have to walk from the checkout stand to where the item they wanted was located, bring the item back to the checkout stand, and repeat this process for every item on their grocery list. Such an inefficient way of assembling packages is detrimental to the contractor, because it takes longer to assemble their package. It is also detrimental to the supplier because it results in increased labor cost and increased wear-and-tear on equipment, such as forklifts, needed to assemble the packages.

In addition to the inefficiency of bringing all the materials to a central assembly area, there are problems in putting the package together once all the materials are in the central area. Each package is strapped together and carried on a truck to the contractor's job site. To properly strap the items together so that the straps hold the package more securely, and so that pieces of the package do not fly off the truck on the way to the job site, the items must be assembled into regularly shaped packages. This is a difficult task to do with a forklift. Thus, the person assembling the contractor's package usually must resort to unloading the materials from the forklift manually and carefully stacking the materials so that a regular shape that can be securely strapped will result. The need for the package assembler to keep getting on and off the forklift and to arrange the package manually add significant time and expense to the preparation of a package.

The problem of putting together packages with regular shapes is presently solved by the use of "splitting bars," which are vertical bars placed in the ground at the central location where the packages are assembled. The items in each order are carried to the central location, raised over the splitting bars and then lowered on the opposite side of the splitting bars. The forklift carrying the building materials then backs up and pulls the building materials into contact with the splitting bars, which aligns the edges of the materials to make a regularly shaped package. Although the splitting bars can be used to assemble a regularly shaped package, they still are limited by being permanently placed in the ground in the central area. Thus, a person assembling an order must still make multiple trips to and from the central area to put the package together.

There is thus a need in the art for an apparatus and method that allows efficient assembly of regularly-shaped packages of building materials.

SUMMARY OF THE INVENTION

The present invention provides a portable rack for assembling packages of building materials. The rack comprises a base having a proximal side, a distal side, a top, a bottom, and a pair of channels extending between the proximal side and the distal side, the channels being designed to receive the forks of a forklift, and a plurality of elongated members attached to the proximal side and projecting upwardly from the base. The process for using the rack comprises placing the building materials onto the base of the rack using the forklift, moving the building materials toward the elongated members until the building materials abut at least one of the elongated members, and pulling the forks out from under the building materials.

DETAILED DESCRIPTION OF THE INVENTION

Described below are six embodiments of the present invention. The embodiments illustrate various ways in which the present invention can be implemented. Although the six embodiments shown are described in the context of a rack used for putting together packages of building materials, the rack can also be used for other purposes. In the descriptions that follow, like numerals represent like elements in all figures. For example, where the numeral 20 is used to refer to a particular element in one figure, the numeral 20 appearing in any other figure refers to the same element.

First Embodiment

Figure 1:
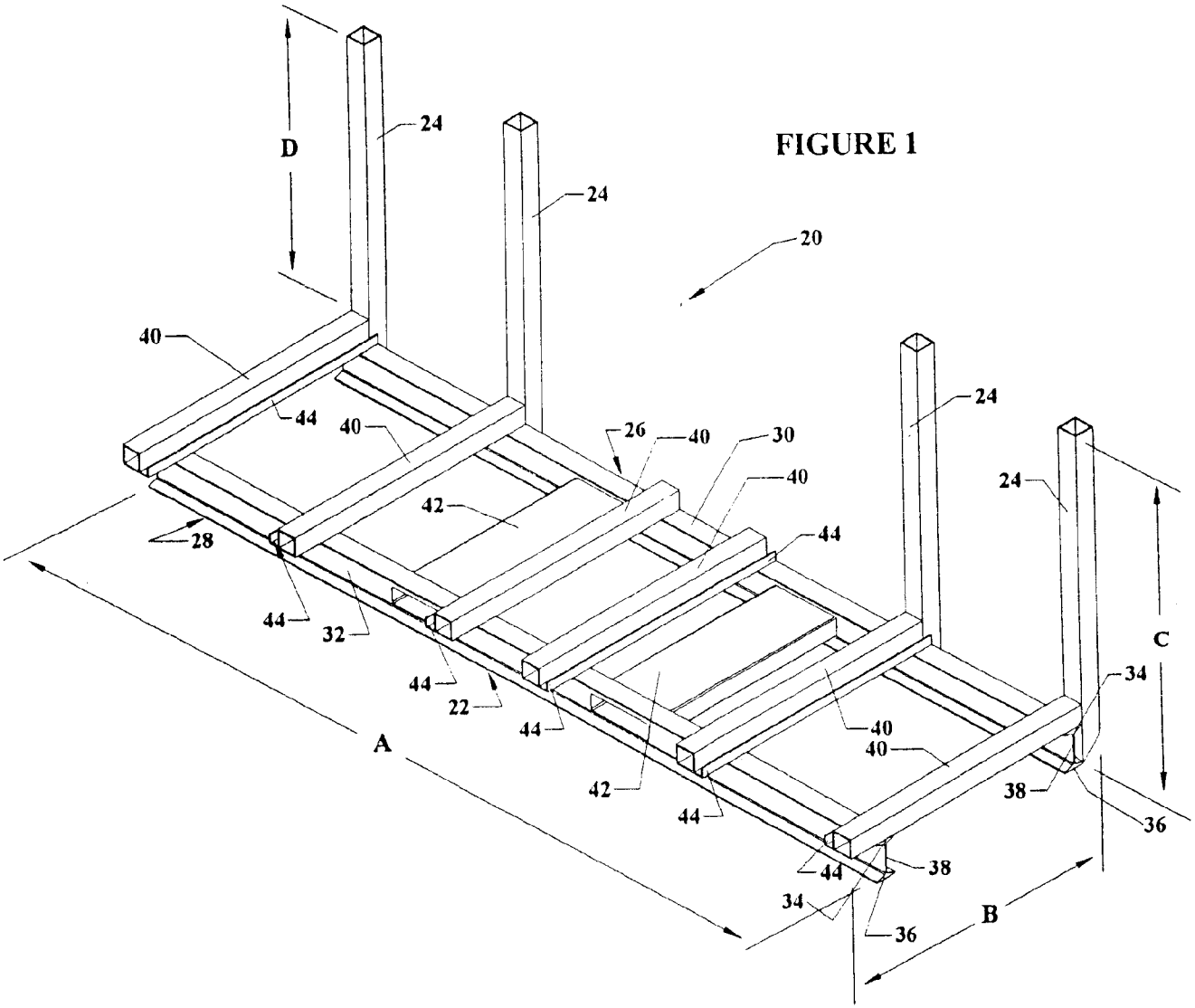
FIG. 1 is an isometric view of a first embodiment of the inventive rack.

FIG. 1 illustrates a first embodiment of a rack 20 useful for assembling packages comprising different types of building materials. The rack 20 comprises two primary elements: a base 22, and a plurality of elongated members or posts 24 projecting upwardly from the base. The rack 20 has an operational height D, an overall height C, an overall length B, and an overall width A. The operational height D can range between 2 feet and 6 feet; the overall height C can range between 3 and 7 feet; the overall length B can be between 3 and 5 feet; and the overall width A can be between 12 and 20 feet. Preferably, the operational height D is 5 feet, the overall height C is 6 feet, the overall length B is 4½ feet, and the overall width A is 14 feet.

The base 22 is rectangular and has a proximal side 26 and a distal side 28. The proximal side 26 comprises a proximal beam 30, while the distal side 28 base comprises a distal beam 32. Each of the proximal and distal beams are steel I-beams having upper flanges 34, lower flanges 36, and webs 38 extending between the upper and lower flanges. Several crossbars 40 extend between the proximal beam 30 and the distal beam 32 and are attached to the upper flanges 34 of both beams. As further discussed below, positioning the crossbars on the upper flanges 34 leaves a space between the top of the crossbar and the flanges (see FIG. 2); this space is advantageous in the use of the rack. The crossbars 40 are preferably welded to the upper flanges 34, but any method of attachment—fasteners such as screws and bolts, for example—will do.

To, provide means for picking up the rack using the forks of a forklift, a pair of channels 42 are built into the base to receive the forklift forks. The channels extend between the proximal beam 30 and the distal beam 32 and are attached to the webs 38 of each beam. In addition, the channels 42 extend through the webs 38 of both beams so that the forklift forks can be inserted therein from the proximal or distal sides of the base 22. Although the drawings illustrate only the channels 42, many other means for picking up the rack with a forklift are possible. For example, crossbars (not shown) could be attached to the bottom flanges 36 of the proximal and distal beams, thus providing a gap between the bottom flanges 36 and the ground. The forklift forks could be inserted into this gap to lift the rack.

Several elongated members or posts 24 project upwardly from the base and are attached to the lower flange 36 and upper flange 34 of the proximal beam 30. The posts 24 may also be attached to those crossbars 40 that are attached to the upper flange 34 of the proximal beam at the same location. The posts 24 are preferably welded to the flanges and crossbars, but may also be attached by other means such as fasteners. To avoid unnecessary lifting and wear and tear on the forklift, posts 24 having operational heights D between 2 and 6 feet may be used, depending on the height of the packages being assembled (see also FIG. 3). For example, if a particular package is only 2 feet high, then posts with an operational height of 2 feet may be used. To enhance the flexibility of the rack the posts may be made removable, so that they can quickly be swapped with posts of different operational height when the need arises. Such an arrangement of removable posts could be implemented by attaching the posts 24 to the base with fasteners, by building receptacles into the base which would receive and secure the posts therein, or by other means.

The spacing between posts 24 is chosen so that the building materials to be carried on the rack will always abut at least two posts. Different building materials come in standardized sizes. For example, long stock such as lumber typically comes in lengths between 8 and 26 feet in 2 foot increments; panel stock, such as plywood, typically comes in four-foot-wide sheets and lengths from 8 to 10 feet in 1-foot increments; siding products come in lengths between 3 and 20 feet; and engineered products such as joists and beams come in 48, 60 or 68 foot lengths. For the rack 20, the spacing between posts is chosen such that two 4 foot by 8 foot sheets of plywood may be placed on the rack with their ends abutting each other near the center of the rack.

Figure 2:
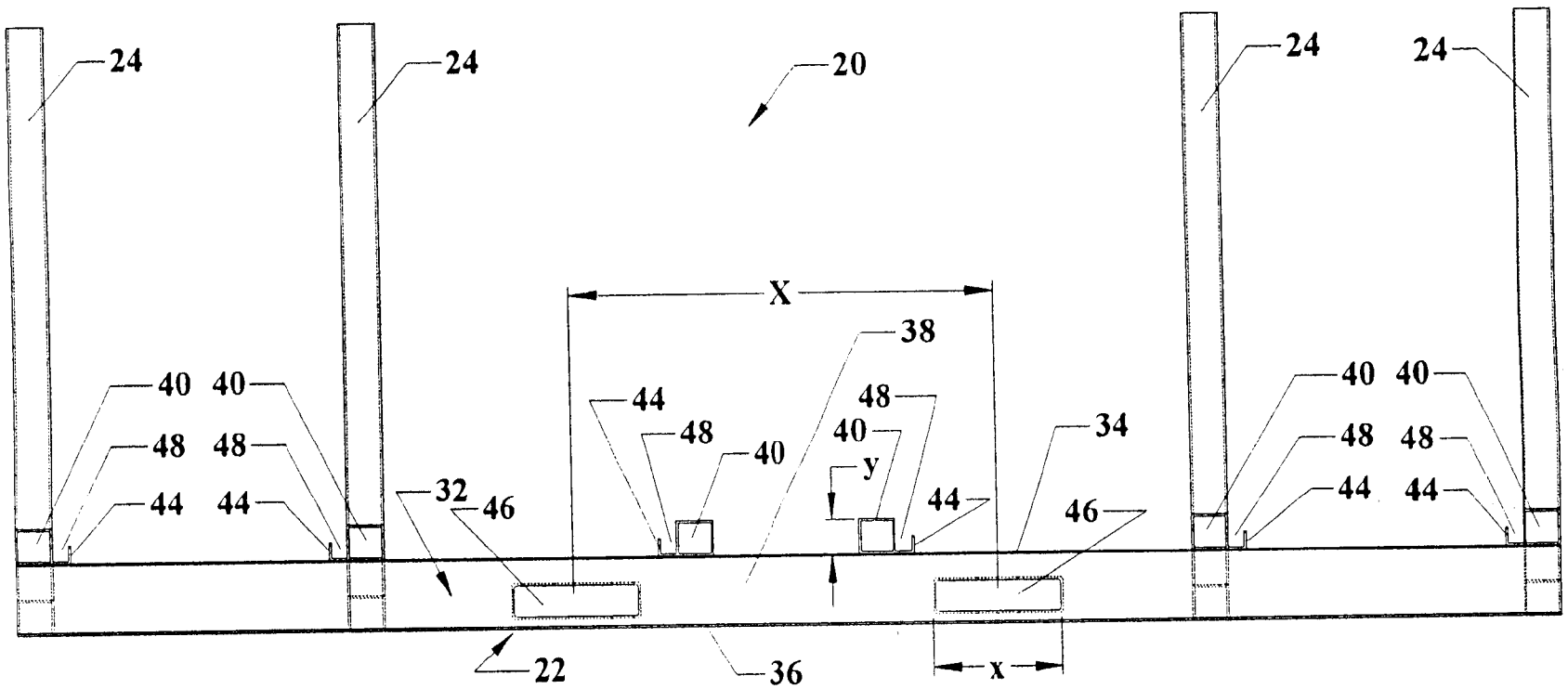
FIG. 2 is a front elevation of the first embodiment of the inventive rack.

FIG. 2 illustrates the rack 20 viewed from the distal side 28. The distal beam 32 and proximal beam 30 (not shown) have holes 46 in their webs 38 to accommodate the channels 42 and allow the forklift forks to be inserted in the channels. Forklifts come in various sizes with different fork spacing, so the distance X between the centers of the holes 46, and the width x of each hole (and the corresponding size of the channels) are chosen so that the rack can accommodate a variety of forklifts. The crossbars 40 are attached to the upper flanges 34 of the distal and proximal beams. When the crossbars 40 are attached to the upper flanges 34 a distance y remains between the top of the crossbar and the flange. When building materials are placed on the base 22, they will rest on the tops of the crossbars. The distance y between the top of the crossbars and the flange allows the forklift forks to be pulled out from under the building materials once they are placed on the base, and also allows the forks to be inserted under the package of building materials when the package is to be lifted off the rack 20 after its completion.

An additional feature shown in FIG. 2 are the strapping guides 44, in one aspect L-brackets, which extend between the proximal and distal beams and are attached to the upper flanges of each. Each L-bracket 44 is positioned with one leg abutting a crossbar 40. This arrangement of the L-brackets creates a channel 48 through which straps can easily be fed once all the required building materials are placed on the rack. The materials on the rack can thus be easily strapped together.

Figure 3:
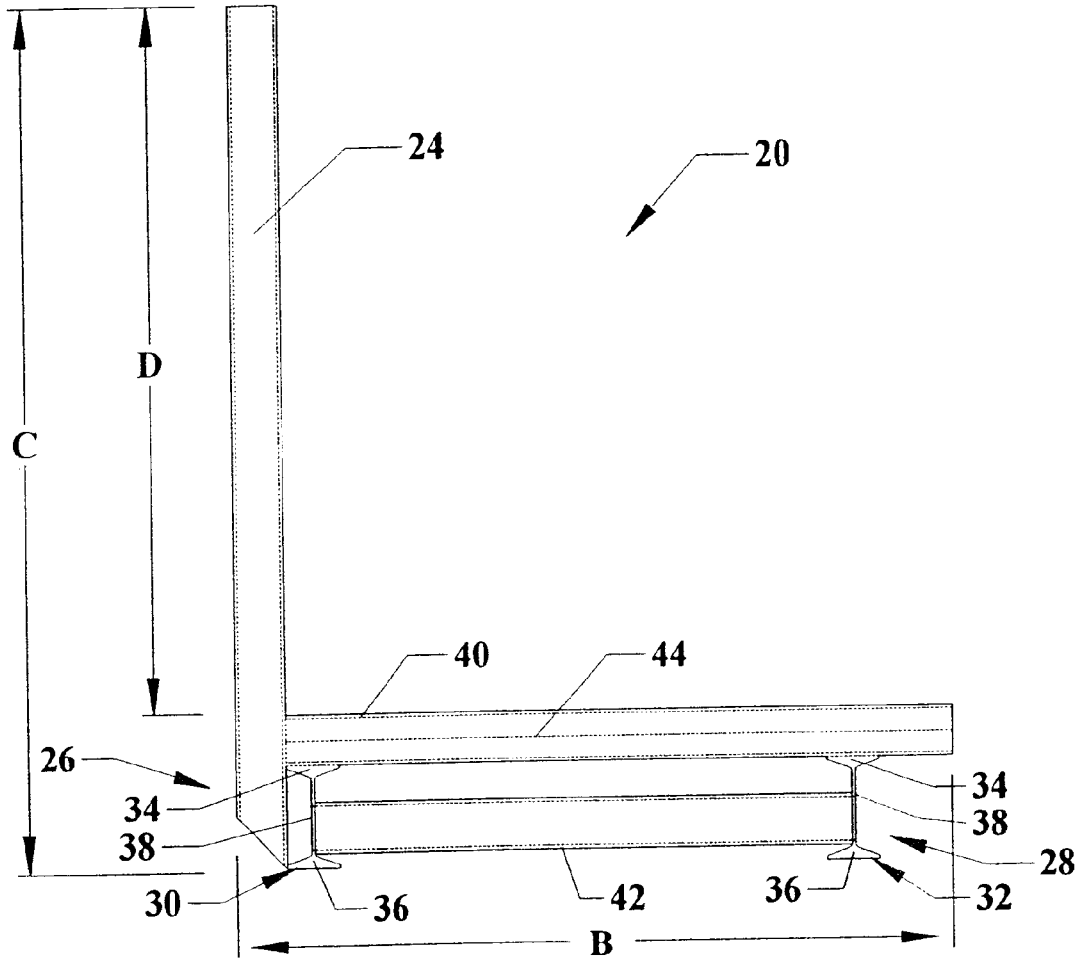
FIG. 3 is a side elevation of the first embodiment of the inventive rack.

FIG. 3 illustrates the connection of the crossbars 40, posts 24 and channels 42 to the rack 20. The crossbars 40 extend between the proximal beam 30 and the distal beam 32 and are attached to the upper flanges 34 thereof The crossbars 40 project beyond the distal beam 32 to provide more support, so that materials carried on the rack will be less likely to slide off the distal side when the rack is carried from the proximal side. The posts 24 are attached to the proximal beam 30 along the edges of its upper flange 34 and lower flange 36. The channels 42 extend between, and are attached to, the webs of the proximal and distal beams. The channels 42 also extend through the webs of the beams so that the forks can be inserted in the channels. The operational height D between the tops of the crossbars 40 and the tops of the posts 24 is an important dimension, as it determines the size of packages that can be put together on the rack. An optional feature (not shown) is a rubber pad attached to the bottom of the base, preferably to the lower flanges 36 of each of the proximal and distal beams. When installed, the rubber pad prevents the rack 20 from sliding around on certain surfaces, such as pavement, when in use.

The operation of the rack 20 will be described with reference to FIG. 1, and in the context of assembling packages of building materials. A typical order of building materials consists of several different types of material used for a common purpose. For example, a framing order may contain all the building materials necessary to set up the basic frame of a house. Such a framing package may contain lumber to be used as studs, plywood sheets to be used as floor or wall panels, and drywall to be used in the interior walls of the house. Preferably, the package of building materials is put together such that the materials to be used first are on top of the package. In other words, the packages are put together in last-in, first-out (LIFO) order.

In operation of the rack 20, a forklift operator approaches the proximal side 26 of the rack with a forklift and inserts the forks into the channels 42 on the proximal side. The forks are raised, lifting the rack off the ground, and the rack 20 is carried to where an item of building material for the order is located. The rack may also be carried from the distal side rather than the proximal side.

Once at the proper location, the rack 20 is lowered onto the ground and the forks are removed from the channels. The forklift operator finds the item of building materials he or she needs (for example, several sheets of plywood), picks it up with the forklift, and carries it over to the rack 20. The operator lifts the item over the tops of the elongated members or posts 24 and moves the forklift toward the proximal side of the rack until the building materials have cleared the tops of the posts 24 and are directly over the base 22. The operator may position the forks such that they are between the centermost posts 24, or may position the forks such that they will straddle one or more of the posts when lowered. On some forklifts, the forks are capable of sideways translation. When such a forklift is used, the sideways translation can be used to align the items on the rack and to assure that the building materials abut at least two posts 24.

When the item is positioned over the base 22, the operator lowers the item of building material until it is just above the base. The operator then backs the forklift away from the proximal side of the rack until the item resting on the forks abuts the posts 24. By pulling the item against the posts 24, the item automatically aligns along the posts, so that a clean, flush side is created and a regularly shaped package can be produced. It is important that the item abut at least two posts 24; if the item abutted only one post, it would tend to rotate when pulled against the post and not align along the post, thus defeating the goal of creating a regularly shaped package. The item also must abut at least two posts so that it does not rotate about the posts while the rack is in transit on the forklift, at which time the rack is subject to jostling or tilting on the forklift carriage. Once the item abuts the posts 24, it is lowered onto the base and the operator backs the forklift away from the proximal side 30, thus pulling the forks from underneath the item and leaving the item sitting on the base 22. If necessary, the operator can drive the forklift around to the distal side of the rack and use the forks to push the materials toward the proximal side until they abut the elongated members.

Having finished loading the first item of building materials on the rack, the operator lowers the forks and approaches the proximal side 30 of the rack 20 until the forks are inserted into the channels 42. The rack and building materials are then lifted and carried to where the next item in the package will be placed on the rack. The above process is repeated for each item or group of items to be added to the package, with each successive item being stacked on top of any items already on the base. In cases where items might roll off the distal side of the rack, the operator can also pick up and carry the rack 20 from the distal side. When the rack is picked up from the distal side, the forklift's carriage abuts the distal side of the rack and prevents items from rolling off. Alternatively, if items that can easily roll off the rack are to be carried, racks 50, 56 or 88 (see FIGS. 4, 6 and 10) could be used.

When the package of building materials is finally assembled, it can be strapped together by inserting, for example, metal straps into the channels 48 created by the L-brackets 44 abutting the crossbars 40. Once fed under the package, the straps are brought back around the top of the package, fastened together and tightened to secure the package. After strapping, the package can be lifted onto a truck by inserting the forks into the space between the crossbars 40 and the upper flanges 34 (see FIG. 2) and lifting the package off the rack and onto the truck.

An alternative way of using the rack 20 is simply to use it to carry large loads that would be unstable if carried on the forks of a forklift. Thus, very long loads that wold be unstable because of the close spacing between forklift forks could be placed on the rack. Because the rack is much wider than the forks, the item placed on the rack are much more stable while being carried on the forklift.

Using the rack 20 with the process described above has several advantages. First, the package of building materials ends up being regularly shaped with flush edges. This means that no further labor is required to put the package into a shape that can be easily and securely strapped together. Second, use of the rack 20 decreases the labor required to assemble a package. The operator using the rack need never get off the forklift to assemble the load, and need not periodically adjust the items in the package so that a properly shaped package will result. Finally, the rack saves time and forklift operating costs by eliminating the many trips to and from the central package assembly area previously required to put together a package.

Second Embodiment

Figure 4:
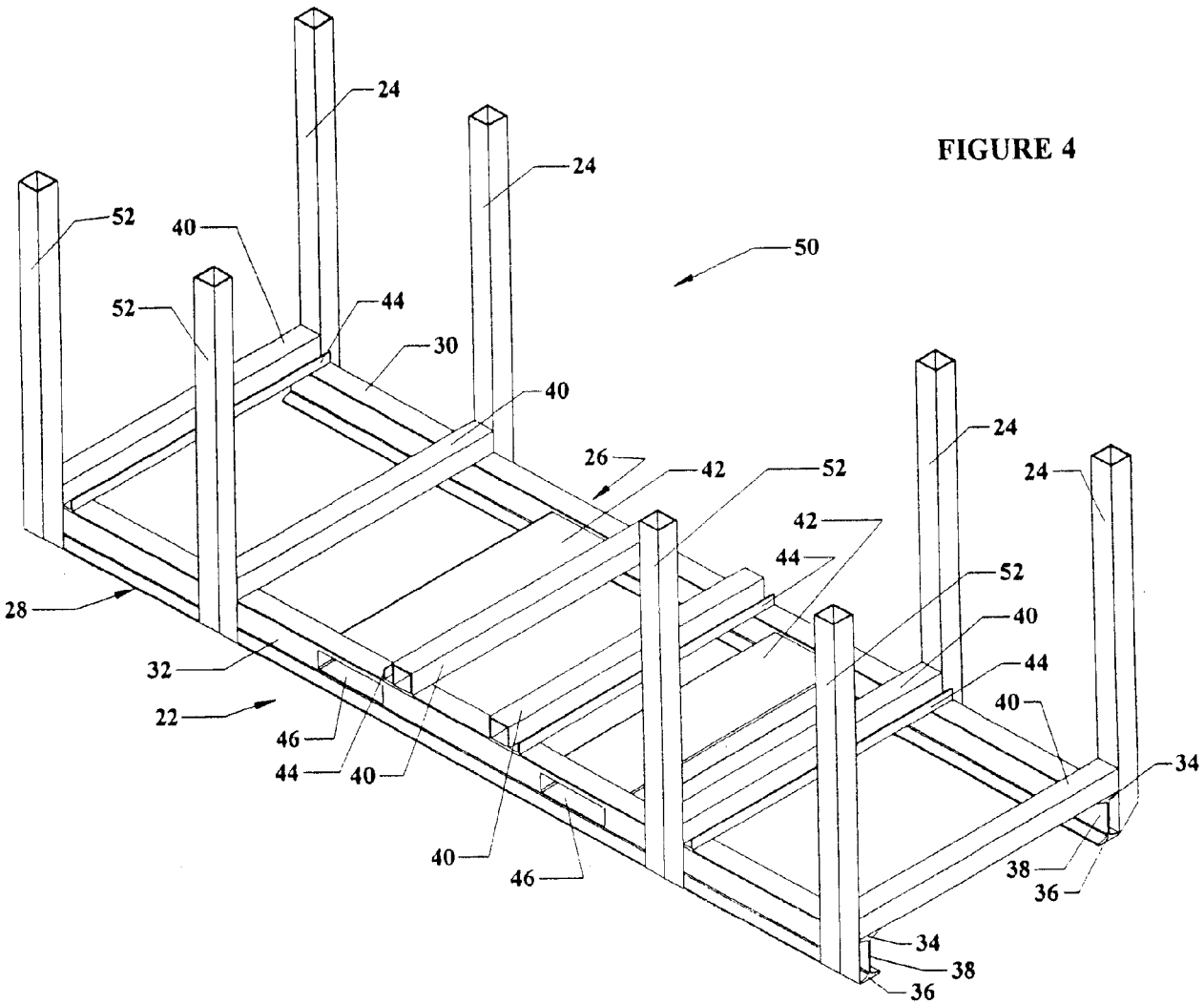
FIG. 4 is an isometric view of a second embodiment of the inventive rack.

FIG. 4 illustrates a second embodiment 50 of the inventive rack. The rack 50 is nearly identical to the rack 20, except for the addition of a plurality of posts 52 attached along the distal beam 32.

The rack 50 is used in the same way as the rack 20, except that the rack 50 is used for building materials that fit between the posts 24 and 52 on the proximal and distal sides of the rack. It Is also used for materials that could easily roll or slide off the rack if the posts 52 were not there. Moreover, because the rack 50 is symmetrical, it can be loaded from either the proximal side 26 or the distal side 28.

Third Embodiment

Figure 5:
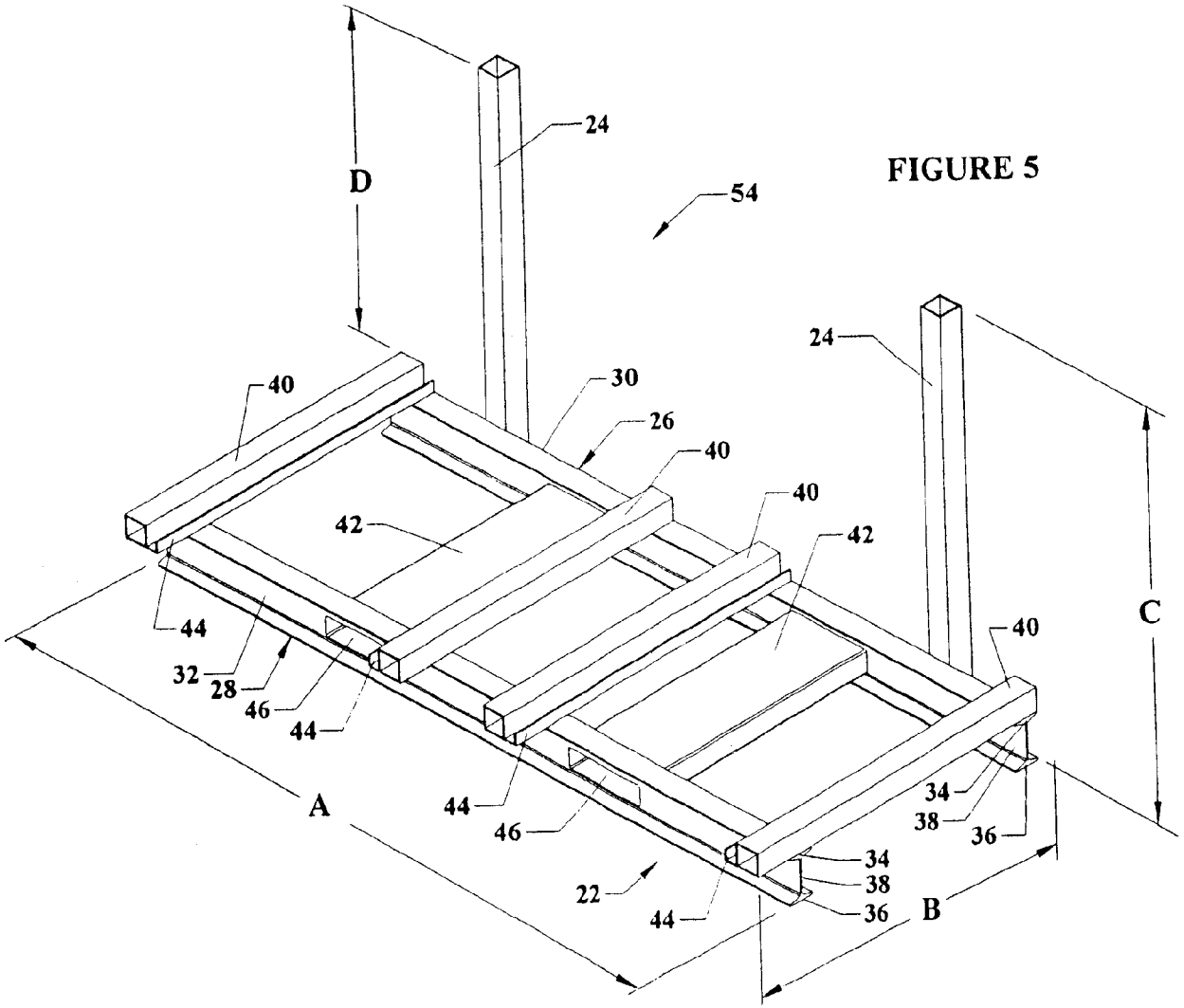
FIG. 5 is an isometric view of a third embodiment of the inventive rack.

FIG. 5 illustrates a third embodiment 54 of the inventive rack. The rack 54 is a smaller variant of the rack 20, also comprising a base 22 with a plurality of elongated members or posts 24 projecting upwardly from one side of the base. The operational height D can range between 2 feet and 6 feet, the overall height C can range between 3 and 7 feet, the overall length B can be between 3 and 5 feet, and the overall width A can be between 12 and 20 feet. For this embodiment, the preferred dimensions are 5 feet for D, 10 feet for A, 4½ feet for B, and 6 feet for C.

Like the rack 20, the base 22 is rectangular and has a proximal side 26 and a distal side 28. The proximal side of the base 22 is constructed using a proximal beam 30, while the distal side 28 of the base is constructed using a distal beam 32. Both the proximal and distal beams are steel I-beams having upper flanges 34, lower flanges 36 and webs 38. Several crossbars 40 extend between the proximal beam 30 and the distal beam 32 and are attached to the upper flanges 34 of the proximal and distal beams. The crossbars 40 project a selected distance beyond the distal beam to provide more support, so that materials will be less likely to slide or roll off the distal side of the rack.

A pair of channels 42 are built into the base to allow the rack to be picked up using the forks of a forklift. The channels extend between the proximal beam 30 and the distal beam 32 and are attached to the webs 38 of each of the beams. The channels 42 extend through the webs 38 of both beams so that the forks can be inserted therein from the proximal or distal sides of the base 22. The elongated members or posts 24 are attached to the lower flange 36 and upper flange 34 of the proximal beam 30, preferably by welding, but other means such as fasteners may be used.

The rack 54 is used in the same way as the rack 20, except that it tends to be used for smaller loads.

Fourth Embodiment

Figure 6:
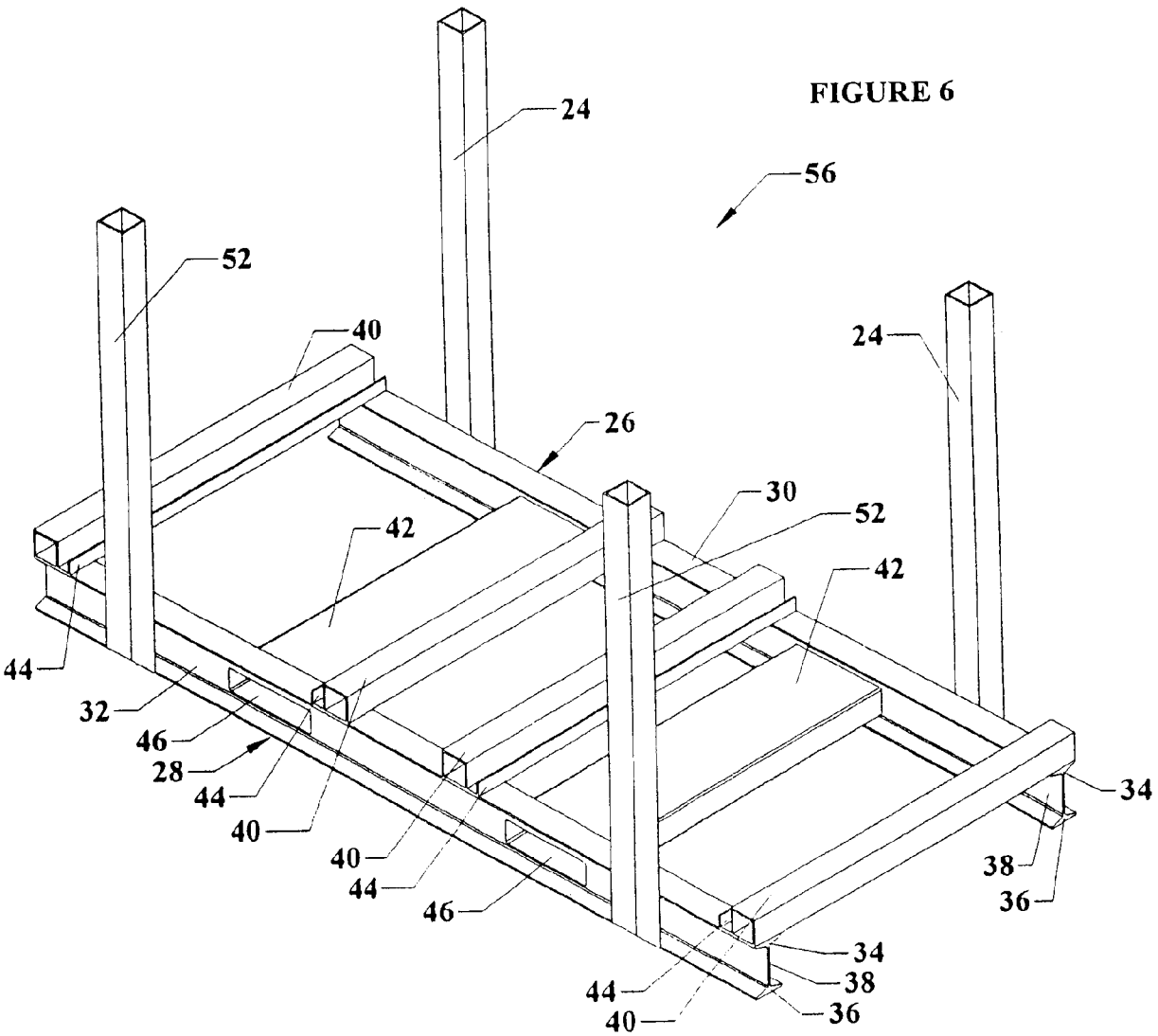
FIG. 6 is an isometric view of a fourth embodiment of the inventive rack.

FIG. 6 illustrates a fourth embodiment of the rack 56. The rack 56 is nearly identical to the rack 54, except for the addition of a plurality of elongated members or posts 52 along the distal beam 32.

The rack 56 is used in the same way as the rack 54, except that the rack 56 is used for building materials that do not exceed the distance between the posts 24 and 52 on the proximal and distal sides of the rack. It is also used for building materials that might easily slide or roll off the rack without the posts 52. Moreover, because the rack 56 is symmetrical, it can be loaded from either the proximal side 26 or the distal side 28.

Fifth Embodiment

Figure 7:
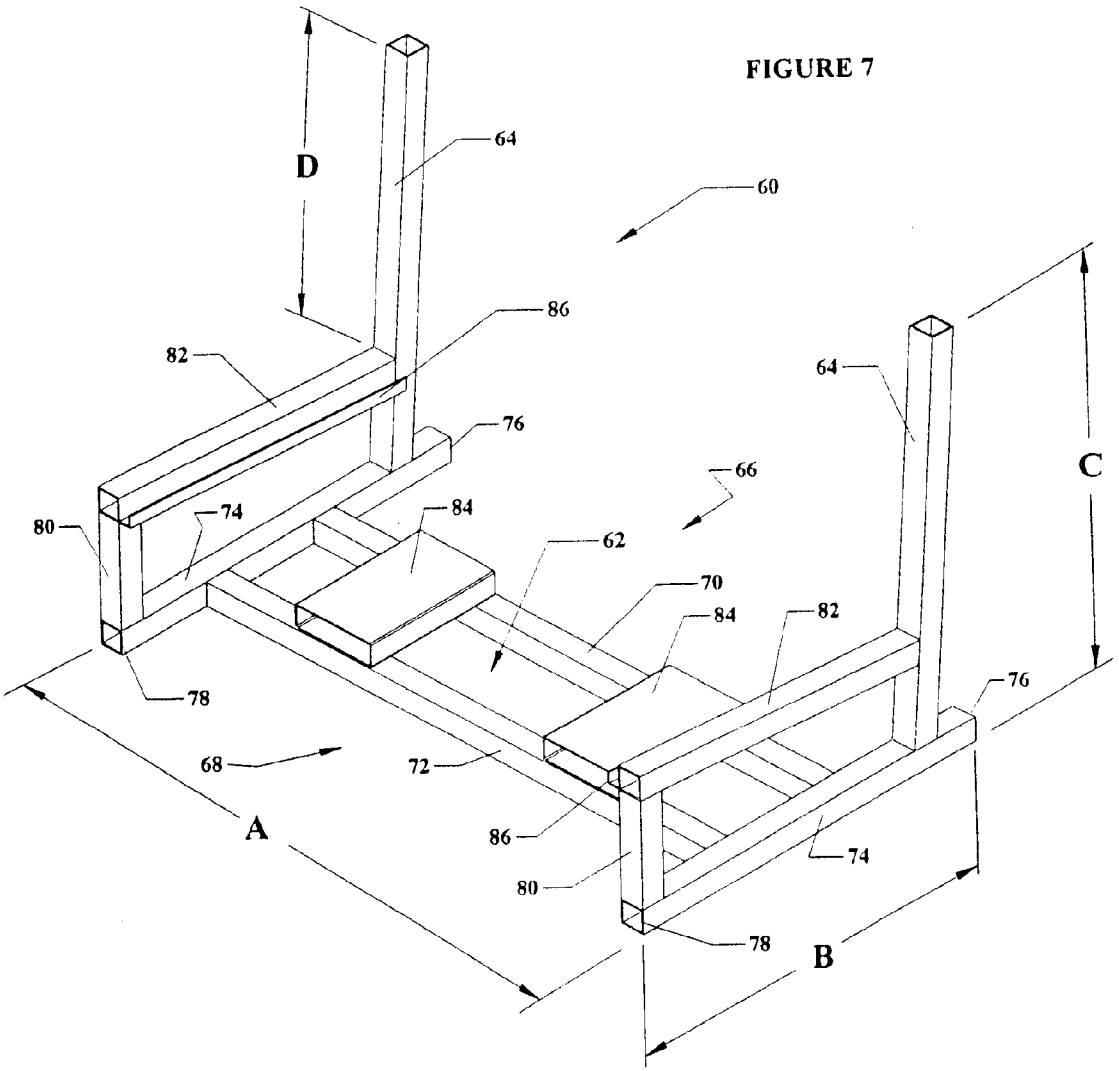
FIG. 7 is an isometric view of a fifth embodiment of the inventive rack.

FIG. 7 illustrates a fifth embodiment of the rack 60. The rack 60 is configured differently than any of the racks previously described. The rack 60 is primarily designed for building materials that should be maintained in a particular orientation, but may also be used for any other materials in the same way as any of the racks described above. The rack 60 comprises two primary elements: a base 62, and a pair of first elongated members or posts 64 projecting upwardly from the base. For this embodiment, the operational height D can range between 2 and 6 feet, the overall height C can range between 3½ and 7½ feet, the overall length B can be between 4 and 5 feet, and the overall width A can be between 7 and 20 feet. The preferred dimension for A is 7½ feet, for B it is 5 feet, for C it is 6 feet, and for D it is 4 feet.

The base 62 has a proximal side 66 and a distal side 68. The base 62 comprises a proximal beam 70, and a distal beam 72. The proximal beam 70 and distal beam 72 extend between two crossbars 74 and are attached to each crossbar symmetrically about its midpoint. Each crossbar has a first end 76 on the proximal side of the base, and a second end 78 on the distal side of the base. A first pair of elongated members or posts 64 are attached to the crossbars near their first ends and a second pair of shorter posts 80 are attached to the second ends of the crossbars. A support member 82 is attached to the tops of the second posts 80 and to a point on the posts 64 such that the support members 82 are positioned at a selected angle relative to the crossbars 74. A pair of channels 84 are attached to the base to allow the rack to be picked up using the forks of a forklift. The channels 84 extend between the proximal beam 70 and the distal beam 72 and are attached to both beams. The proximal beam, distal beam, channels, posts and support members are all made using steel channel. All components of the rack 60 are preferably attached to each other by welding, but other means such as fasteners may be used.

Figure 8:
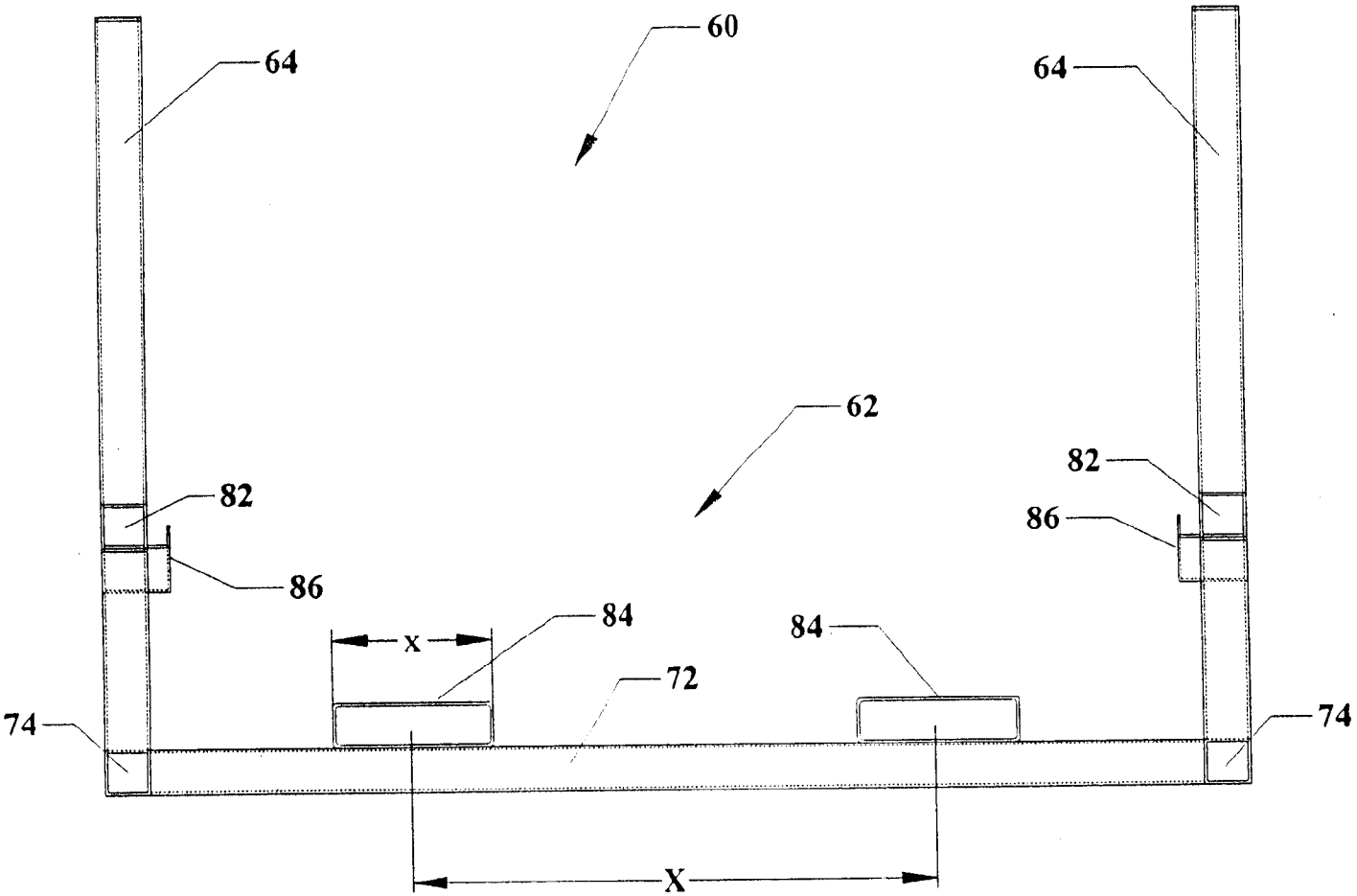
FIG. 8 is a front elevation of the fifth embodiment of the inventive rack.

FIG. 8 illustrates the rack 60 viewed from the distal side. The channels 84 are attached to the proximal beam 70 (not shown) and distal beam 72. Forklifts come in various sizes with different spacing between forks, so the spacing X between the centers of the channels 84, and the width x of each of the channels, are chosen so that the rack can accommodate a variety of forklifts. The distal beam 72 and the proximal beam 70 (not shown) extend between and are attached to the crossbars 74. An additional feature shown in FIG. 8 are the L-brackets 86, which are attached to the support member 82 and are positioned with one leg abutting each support member. This arrangement of the L-brackets creates a channel through which straps can easily be fed once all the required materials are placed on the rack. The materials on the rack can thus easily be secured together with straps.

Figure 9:
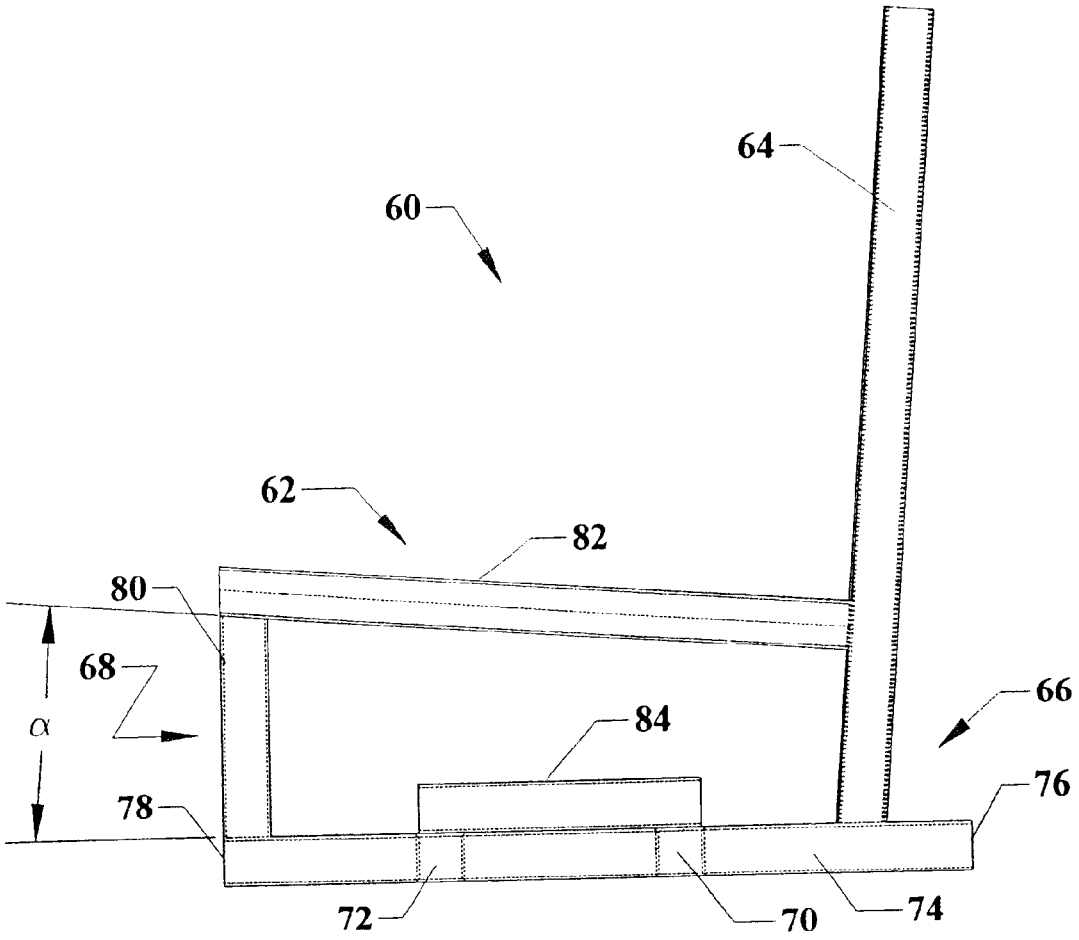
FIG. 9 is a side elevation of the fifth embodiment of the inventive rack.

FIG. 9 illustrates the connection of the crossbars 74, posts 64 and 80 and channels 84 to the rack 60. The proximal beam 70 and the distal beam 72 extend between the crossbars 74. The pair of first posts 64 are attached near the first ends of the crossbars 74, while the pair of second posts 80 are attached to the second ends of the crossbars. The support member 82 extends between the tops of the second posts 80 and a point on the first posts 64, and is positioned to form a selected angle a between itself and the crossbars; the angle ax varies between about 0 degrees and about 15 degrees and is preferably about 4½ degrees. The channels 84 extend between, and are attached to, the proximal and distal beams. An optional feature (not shown) is a rubber pad that is attached to the bottom of the proximal and distal beams and the crossbars. When installed, the rubber pad prevents the rack 60 from sliding around on the pavement when in use.

The rack 60 is used in the same way as the previous racks, except that it is primarily used for materials that must be maintained in a certain orientation. It may, however, be used for any materials in the same way as any of the racks previously described.

Sixth Embodiment

Figure 10:
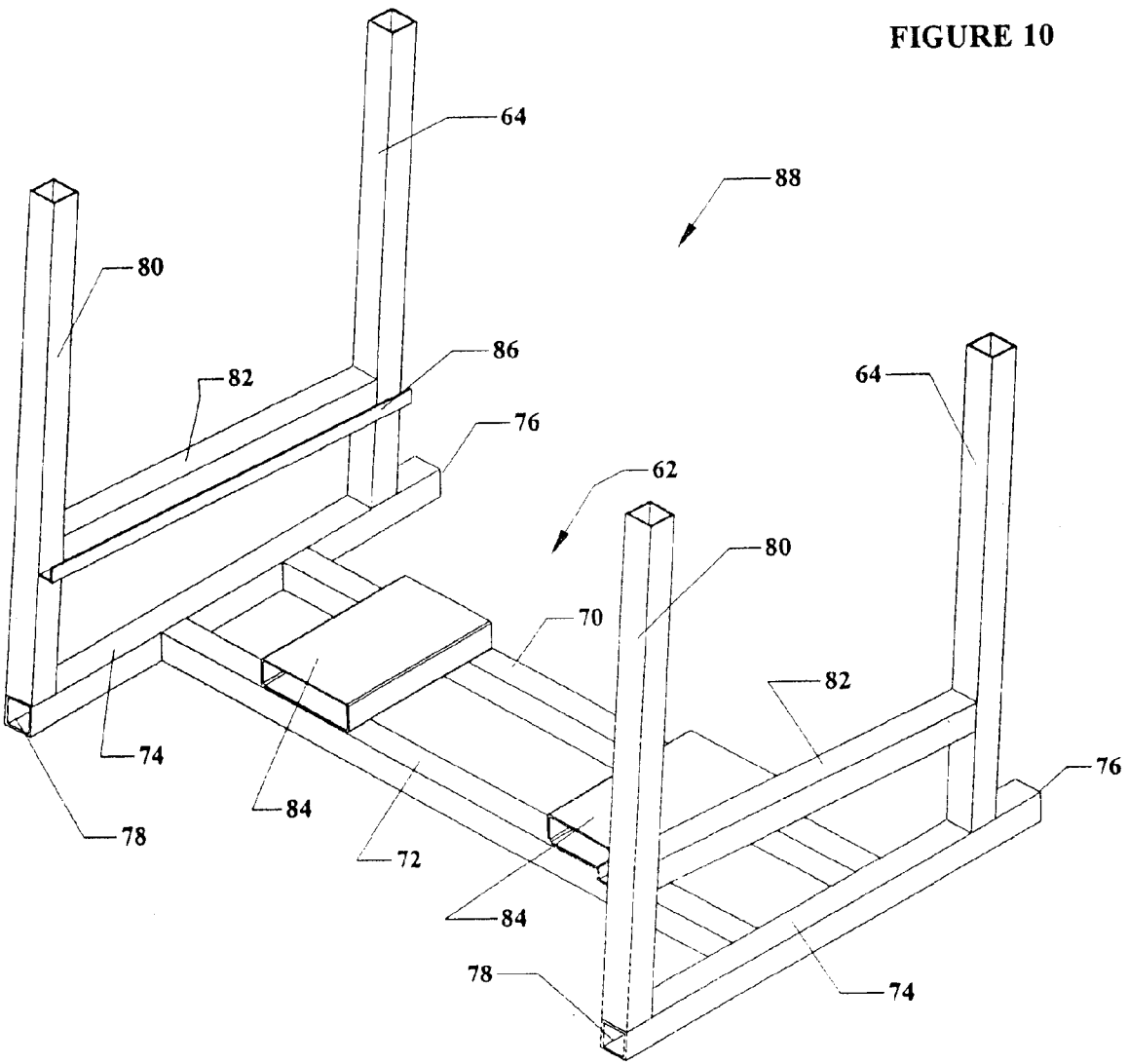
FIG. 10 is an isometric view of a sixth embodiment of the inventive rack.

FIG. 10 illustrates a fourth embodiment of the rack 88. The rack 88 is nearly identical in construction to the rack 60, except that the second posts 80 have been lengthened to be approximately the same length as the posts 64, and the support member 82 now is attached to points on the second posts 80 rather than to their ends.

The rack 88 is used in the same way as the rack 60, except that the rack 88 is used building materials that do not exceed the distance between the proximal and distal sides of the rack or materials that might slide or roll off the distal side of the rack. Moreover, because the rack 88 is nearly symmetrical, it can be loaded from either the proximal side 66 or the distal side 68.

Six embodiments of the present invention have been described. A person skilled in the art, however, will recognize that many other embodiments are possible within the scope of the claimed invention. For this reason, the scope of the invention is not to be determined from the description of the embodiments, but must instead be determined solely from the claims that follow.

What is claimed is:

1. A portable rack for assembling packages of building materials comprising:

a base having a proximal side, a distal side, a top, a bottom, and means for lifting the rack;

a plurality of elongated members attached to the proximal side and projecting upwardly from the base;

wherein the base comprises a proximal beam, a distal beam parallel to the proximal beam, and a plurality of crossbars extending between the proximal and distal beams and being perpendicular thereto; and a strapping guide attached to the proximal and distal beams and abutting the crossbars to create an open channel through which straps unsecured to the rack are fed.

2. The rack of claim 1 wherein the elongated members have an operational height of between about 2 feet and about 6 feet, the distance between the proximal and distal sides is from about 3 feet to about 5 feet, and the proximal and distal sides have equal lengths of from about 10 feet to about 20 feet.

3. The rack of claim 1 wherein the plurality of crossbars project a selected distance beyond the distal beam.

4. The rack of claim 1 wherein the proximal and distal beams are I-beams, wherein each I-beam has two flanges separated by a web, and the plurality of crossbars are attached to the flanges of the proximal and distal beams.

5. The rack of claim 4 wherein the means for lifting the rack with the forks of a forklift comprise a pair of channels extending between the web of the proximal beam and the web of the distal beam.

6. The rack of claim 1 wherein the strapping guide is an L-bracket.

7. The rack of claim 1 further comprising a rubber pad attached to the bottom of the base.

8. The rack of claim 1 wherein the plurality of elongated members attached to the proximal side of the base are two first elongated members, and the crossbars each have a first end on the proximal side of the base and a second end on the distal side of the base, the proximal beam and the distal beam extending therebetween the crossbars and attached to each crossbar between the first and second ends thereof, the base further comprising:

a pair of second elongated members attached to and projecting upwardly from the second ends of the crossbars; and a pair of support members connecting the second elongated members to the first elongated members, the first elongated members being attached to and projecting upwardly from the first ends of the crossbars, and the support members being positioned at a selected angle relative to the crossbars.

9. The rack of claim 1 wherein the elongated members are welded to the base.

10. The rack of claim 1 wherein the elongated members are attached to the base using fasteners.

11. The rack of claim 1 wherein the elongated members are spaced apart at a distance such that each item of building materials placed on the rack will abut at least two elongated members.

12. The rack of claim 1 further comprising a plurality of elongated members attached to the distal side of the base.

13. A portable rack for assembling packages of building materials, comprising:

a base having a proximal beam, a distal beam parallel to the proximal beam, a plurality of crossbars extending between the proximal and distal beams and being normal thereto, and a pair of channels extending between the proximal and distal beams;

a plurality of elongated members attached to the proximal beam and projecting upwardly from the base; and a strapping guide abutting the crossbars to create a channel through which straps unsecured to the rack are fed.

14. The rack of claim 13 wherein the elongated members have an operational height from about 2 feet to about 6 feet, the distance between the proximal and distal beams is from about 3 feet to about 4 feet, and the proximal and distal beams have equal lengths from about 10 feet to about 20 feet.

15. The rack of claim 13 wherein the proximal and distal beams are I-beams, each having two flanges separated by a web, and the plurality of crossbars are attached to the flanges of each of the proximal and distal beams.

16. The rack of claim 13 wherein the plurality of crossbars project a selected distance beyond the distal beam.

17. The rack of claim 13 wherein the strapping guide is an L-bracket.

18. The rack of claim 13 wherein the elongated members are spaced apart at a distance such that the building materials placed on the rack will abut at least two elongated members.

19. The rack of claim 13 further comprising a rubber pad attached to a bottom of the base.

20. The rack of claim 13 further comprising elongated members attached along the distal beam and projecting upwardly from the base.

21. The rack of claim 13 wherein the elongated members are attached to the base using welding.

22. The rack of claim 13 wherein the elongated members are attached to the base using fasteners.

23. A portable rack for assembling packages of building materials, comprising:

a base having a proximal side, a distal side, a top and a bottom, wherein the base comprises a pair of crossbars, each having a first end on the proximal side of the base and a second end on the distal side of the base, and a proximal beam and a distal beam extending between the crossbars and attached to each crossbar between the first and second ends thereof,; the base further has a pair of channels attached to and extending between the proximal beam and the distal beam;

a pair of first posts attached to and projecting upwardly from the first ends of the crossbars;

a pair of second posts attached to and projecting upwardly from the second ends of the crossbars; and a pair of support members connecting the second posts to the first posts, wherein the support members are positioned at a selected angle relative to the crossbars.

24. The rack of claim 23 wherein the elongated members have an operational height from about 2 feet to about 6 feet, the distance between the proximal and distal beams is from about 4 feet to about 5 feet, and the proximal and distal beams have equal lengths from about 8 feet to about 20 feet.

25. The rack of claim 23 wherein the spacing between first posts is chosen such that building materials placed on the rack will abut both first posts.

26. The rack of claim 23 wherein the second posts are shorter than the first posts, and the support members connect the ends of the second posts to a point on the first posts.

27. The rack of claim 23 wherein the second posts are approximately the same length as the first posts and the support members connect points on the second posts to points on the first posts.

28. The rack of claim 23 wherein the first and second posts are attached to the base by welding.

29. The rack of claim 23 wherein the first and second posts are attached to the base using fasteners.

30. The rack of claim 23 wherein the selected angle is between about 0 degrees and about 15 degrees.

* * * * *